United States Patent [19]

Wagener

[11] 4,133,719

[45] Jan. 9, 1979

[54] PROCESS AND APPARATUS FOR CHARGING INCLINED CHAMBER COKE OVEN

[75] Inventor: Dietrich Wagener, Essen, Germany

[73] Assignee: Didier Engineering GmbH, Essen, Germany

[21] Appl. No.: 751,707

[22] Filed: Dec. 17, 1976

[30] Foreign Application Priority Data

Dec. 30, 1975 [DE] Fed. Rep. of Germany ..... 2559118

[51] Int. Cl.[2] ..... C10B 57/00; C10B 31/02; B65G 3/00

[52] U.S. Cl. ..... 201/40; 202/128; 214/17 C; 214/18 PH; 214/35 R

[58] Field of Search ..... 201/40; 214/18 PH, 35 R, 214/17 C; 34/38; 202/128

[56] References Cited

U.S. PATENT DOCUMENTS

| | | | |
|---|---|---|---|
| 971,137 | 9/1910 | Mueller | 202/223 |
| 1,255,579 | 2/1918 | Bredel et al. | 202/128 |
| 1,784,650 | 12/1930 | Adams | 214/17 C |
| 1,795,986 | 3/1931 | Adams | 214/17 C |
| 1,795,987 | 3/1931 | Adams | 214/17 C |
| 4,018,655 | 4/1977 | Fach | 201/40 |

FOREIGN PATENT DOCUMENTS

| | | | |
|---|---|---|---|
| 144579 | 9/1903 | Fed. Rep. of Germany | 202/128 |
| 502331 | 1930 | Fed. Rep. of Germany | 201/40 |

*Primary Examiner*—Morris O. Wolk
*Assistant Examiner*—Roger F. Phillips
*Attorney, Agent, or Firm*—Wenderoth, Lind & Ponack

[57] ABSTRACT

An inclined chamber of a coke oven is defined by a heating side wall, a coke removal side, a horizontal chamber ceiling and a chamber floor inclined downwardly from the heating side wall to the coke removal side. Briquettes are charged into the chamber, through charging holes in the heating side wall arranged vertically one above the other and through charging holes in the chamber ceiling arranged one behind the other, in separate inclined fill layers. The charging operation is through separate charging holes, in a sequence from the lowermost charging hole in the heating side wall to the uppermost charging hole therein, and then from the chamber ceiling charging hole closest to the heating side wall to the chamber ceiling charging hole furthest therefrom. The vertical and horizontal spacing between adjacent charging holes is dimensioned to avoid breakage of the briquettes.

1 Claim, 1 Drawing Figure

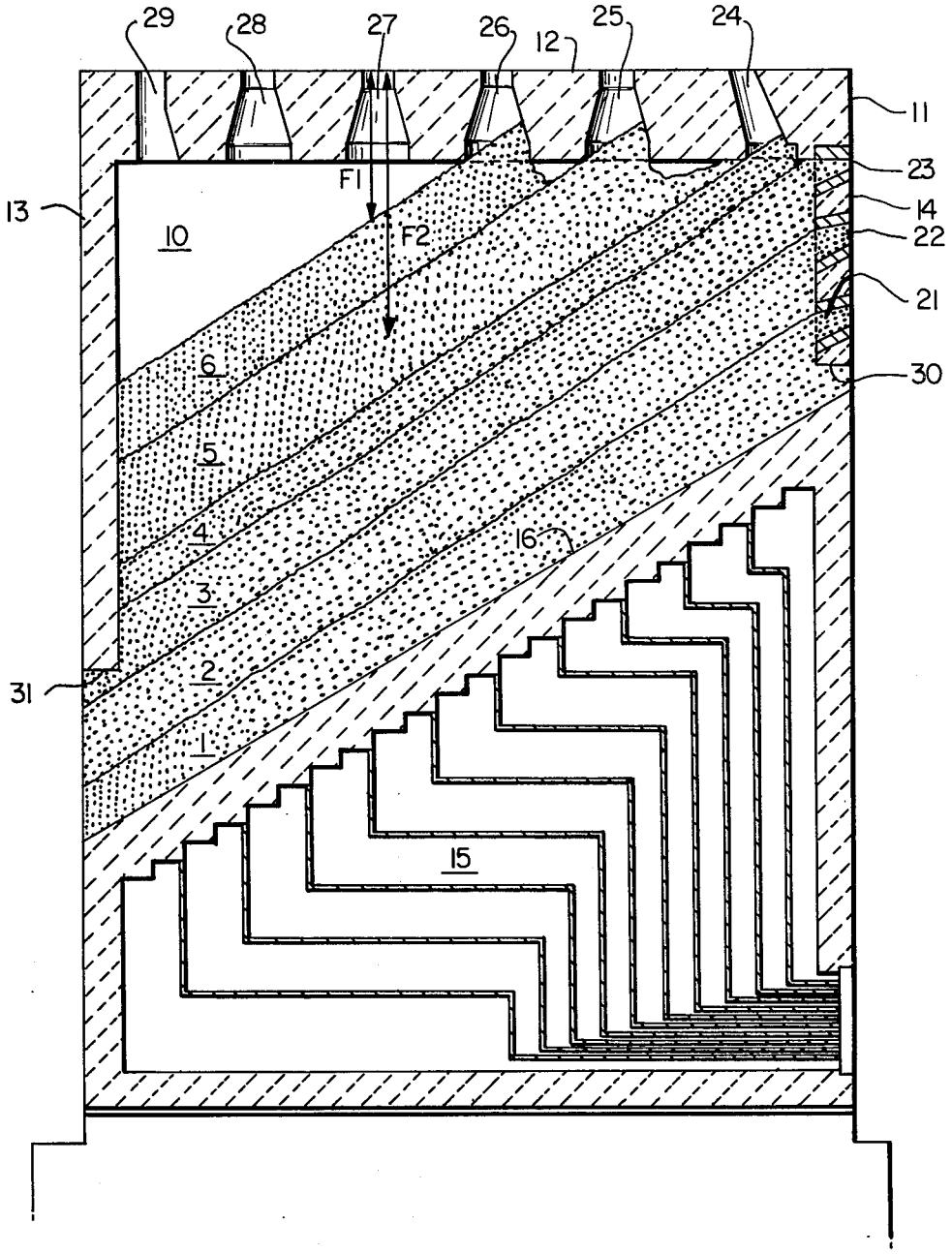
29
28
27
26
12
25
24
11
23
14
22
21
30
13
10
F1
F2
6
5
4
3
2
1
16
31
15

PROCESS AND APPARATUS FOR CHARGING INCLINED CHAMBER COKE OVEN

BACKGROUND OF THE INVENTION

The present invention relates to a process and apparatus for charging the chamber of an inclined chamber coke oven with briquettes.

It is known, in a gasification oven having a walled-up or enclosed gasification chamber, a horizontal ceiling and an inclined floor, to provide a charging hole in the rear area of the horizontal chamber ceiling (German Pat. No. 144,579). Such an arrangement, however, allows only an incomplete filling of the gasification chamber. In the case of an inclined chamber coke oven or gas oven provided with an inclined chamber ceiling and an inclined chamber floor, it is also known to arrange a charging hole at the upper end of the front wall of the chamber, since the charging operation would be difficult through an inclined chamber ceiling (German Pat. No. 229,779). When such a chamber is used, it is possible to fill the entire chamber volume and to thereby provide a uniform coking operation. However, the total chamber volume is substantially lower than in chambers having a horizontal chamber ceiling.

In order to overcome the difficulty of uniform charging in an inclined chamber coke oven having a horizontal chamber ceiling and an inclined chamber floor, it has been proposed to provide a plurality of charging holes in the chamber ceiling.

The charging of material to be formed into coke during a coking operation, in the form of briquettes, into a chamber of an inclined chamber coke oven having a horizontal chamber ceiling and an inclined chamber floor, for the purpose of producing shaped coke, is associated with the particular problem that the briquettes break or burst when introduced through the charging holes and drop therefrom to strike against the floor of the chamber. This detrimentally affects uniform coking of the coke charge, and it becomes difficult to empty the chamber, since the finer coke particles formed in connection with bursting of the briquettes are baked together during the coking operation.

Considerable effort and research have been undertaken to eliminate this problem. For example, it has firstly been attempted to deflect the briquettes from the vertical line of drop by arranging special guiding surfaces in or on the charging holes provided in the chamber ceiling, and secondly to arrange the charging holes obliquely or to round off the inner wall of the chamber after the first charging hole and to the chamber floor, so that the briquettes reach the chamber through a type of chute. The first proposal does not reduce the bursting of the briquettes to the desired extent, and the second proposal results in considerable structural expenditure and in a reduction in uniformity of coking in the frontal area of the chamber. It has also been attempted to increase the strength of the briquettes through preliminary heating or by the use of binders, or to stabilize the briquette firmness through surface coating. These solutions require special energy and procedural steps that cannot be economically justified.

SUMMARY OF THE INVENTION

Accordingly, the object of the present invention is to provide a process and apparatus for charging briquettes into the chamber of an inclined chamber coke oven, without the briquettes breaking or bursting during the charging operation, whatever the height of the chamber.

This object is achieved according to the present invention, in that the charging of the briquettes is undertaken in sequence through a plurality of charging holes provided in the front wall of the chamber, situated on the heating side of the inclined chamber coke oven, and in the horizontal chamber ceiling. The charging operation sequence is started through a lowest charging hole of the front chamber wall provided near the chamber floor, for the purpose of forming a lowest fill layer. The charging operation sequence is continued through a charging hole in the front chamber wall situated above the previously used charging hole until the level of the fill is directly below the chamber ceiling. Then, the charging operation sequence is continued through a charging hole of the chamber ceiling located adjacent the front chamber wall and then through charging holes of the chamber ceiling situated in each case further spaced from the front chamber wall, for the purpose of forming further fill layers. The charging operation sequence is concluded through a charging hole of the chamber ceiling spaced furthest from the front chamber wall, for the purpose of forming an uppermost fill layer.

By providing the above charging sequence the briquettes charged through each charging hole are dropped through only a relatively low height, and breakage of the briquettes is reliably prevented, since the briquettes drop onto the chamber floor only from the lowest charging hole positioned closely thereabove, and onto the respective surfaces of previously formed fill layers only from charging holes in each case positioned only slightly above such surfaces.

The present invention also relates to an inclined chamber coke oven having a horizontal chamber ceiling and a chamber floor dropping in an inclined manner from a heating side to a coke removal side. A plurality of charging holes are arranged one above the other in the front wall of the chamber, and a plurality of charging holes are arranged one after the other in the chamber ceiling, in a direction from the heating side to the coke removal side. Under certain circumstances it is sufficient to arrange only a single charging hole in the front wall of the chamber, at a suitably low level above the chamber floor, if the height through which the briquettes must be dropped is sufficiently reduced in this manner.

The spacing of the charging holes vertically one above the other, and/or horizontally one after the other, is selected such that the particular height through which the briquettes are dropped to the chamber floor, and/or to the surfaces of the respective previously formed fill layers, does not exceed a predetermined value, which is less than that which would cause breakage of the briquettes, thereby reliably avoiding bursting of the briquettes during charging.

Further, one charging hole, or a plurality thereof, can be inclined horizontally or vertically, in order to prevent the free vertical dropping of briquettes already in the charging opening.

BRIEF DESCRIPTION OF THE DRAWING

Further objects, features and advantages of the invention will be apparent from the following description of an exemplified embodiment thereof, taken with reference to the attached drawing, wherein:

The single FIGURE is a schematic sectional view of an inclined chamber coke oven according to the invention, schematically illustrating the process of the invention.

DETAILED DESCRIPTION OF THE INVENTION

A chamber 10 of an inclined chamber coke oven has a horizontal chamber ceiling 12 and a chamber floor 16 dropping in an inclined manner from a heating side 11 to a coke removal side 13 of the oven. Regenerators 15 are arranged beneath chamber floor 16. A coke outlet opening 31 is provided, at the lower end of chamber floor 16, in coke side 13. Opening 31 is closed by a coke oven door (not shown). When such coke oven door is opened, the fill consisting of shaped coke slides from chamber 10. Should the coke stop sliding, it is possible to poke or to apply pressure to the coke through an ejection opening 30 provided in heating side 11 at the upper end of chamber floor 16.

In front wall 14, at heating side 11, a chamber 10 there is provided a plurality of charging holes 21, 22 and 23, each having downwardly inclined inlet surfaces. Charging holes 21, 22 and 23 are arranged one above the other. In horizontal chamber ceiling 12 there is provided a plurality of charging holes 24, 25, 26, 27, 28 and 29 arranged one after the other, in a direction from heating side 11 to coke side 13.

In the embodiment illustrated, foremost or first charging hole 24 in chamber ceiling 12 is shown inclined toward heating side 11. This inclination is not absolutely necessary, but if desired, such inclination may also be provided on the other charging holes 25–29 in chamber ceiling 12. Such inclination tends to retard the free dropping of the briquettes from the particular inlet openings into chamber 10.

The charging of the inclined chamber coke oven with briquettes for the manufacture of shaped coke is started through charging hole 21, through which a fill layer 1 is introduced. This is followed, in sequence, by charging through charging holes 22, 23, 24, 25, 26, 27, 28 and 29, to thereby form further fill layers 2–6 through charging holes 22–26, and further fill layers, which are not shown, for charging holes 27–29. The vertical height of the inner end of charging hole 21 above chamber floor 16 is selected such that the maximum height through which the briquettes will drop is less than the dropping height which would cause the particular briquettes to be introduced to break. Similarly, charging holes 22 and 23 are respectively vertically spaced above charging holes 21 and 22, so that the height of drop, calculated in relation to respective fill layers 1 and 2 that are already introduced, is less than the dropping height which would cause the briquettes to break. Also, the spacing of charging holes 24 to 29 one after the other, in the direction from side 11 to side 13, is selected such that the briquettes are never caused to drop a height which would cause the briquettes to break, when chamber 10 is filled in sequence through charging holes 24–29.

It will be understood that the particular number of charging holes provided in rear wall 14 of the chamber and in chamber ceiling 12 is not itself a critical feature of the invention, since this number would vary dependent on the size of the oven, the inclination of floor 16 and the quality of briquettes used. Further, it is not necessary to utilize every charging hole provided when using briquettes that have a relatively higher resistance to breakage. For example, it could be that the charging operation could be effected through charging holes 22, 24, 26 and 29 only, while still avoiding breakage of the briquettes during charging, on the one hand, and securing a uniform filling of the entire chamber 10, on the other hand.

If the maximum height through which the briquettes can be dropped without breaking is e.g. $F_1$, which is shown with respect to charging hole 27, then obviously a charging operation must first be undertaken through charging hole 26. However, if the maximum height through which the briquettes may be dropped without breakage is $F_2$, then it is obvious that the filling operation through charging hole 26 may be omitted.

Other modifications may be made to the above specifically described structures and operations without departing from the scope of the invention.

What is claimed is:

1. A process for filling a coke oven chamber of an inclined chamber coke oven of the type having a heating side, a coke removal side, a horizontal chamber ceiling and a chamber floor inclined downwardly from said heating side to said coke removal side, said process comprising:

supplying material, in the form of briquettes to be formed into coke during a coking operation, into said chamber through charging holes arranged vertically one above the other in a front wall of said oven at said heating side and one after the other in said chamber ceiling in a direction from said heating side to said coke removal side, said briquettes being supplied in separate charging operations through separate of said charging holes in a sequence from a lowermost charging hole to an uppermost charging hole in said front wall and then from one of said chamber ceiling charging holes closest adjacent said heating side to one of said chamber ceiling charging holes closest adjacent said coke removal side, said charging operations forming separate inclined fill layers arranged sequentially one on top of the other, each of said fill layers being formed to a height so that it is spaced vertically below the next succeeding charging hole in the charging sequence by a distance less than that which would cause breakage of said briquettes dropping to said layer from said next succeeding charging hole in the charging sequence.

* * * * *